US009879953B2

(12) United States Patent
Buchner et al.

(10) Patent No.: US 9,879,953 B2
(45) Date of Patent: Jan. 30, 2018

(54) FIREWORK ACCOMODATING APPARATUS COMPRISING GUIDE ROD, FIREWORK AND ELECTRONIC UNIT

(71) Applicants: Alexander Buchner, Neuoetting (DE); Ralph Kraenzle, Neuoetting (DE)

(72) Inventors: Alexander Buchner, Neuoetting (DE); Ralph Kraenzle, Neuoetting (DE)

( * ) Notice: Subject to any disclaimer, the term of this patent is extended or adjusted under 35 U.S.C. 154(b) by 0 days.

(21) Appl. No.: 15/230,024

(22) Filed: Aug. 5, 2016

(65) Prior Publication Data

US 2017/0038181 A1 Feb. 9, 2017

(30) Foreign Application Priority Data

Aug. 7, 2015 (DE) ..... 10 2015 010 059

(51) Int. Cl.

| | |
|---|---|
| ***F42B 4/22*** | (2006.01) |
| ***F42B 4/06*** | (2006.01) |
| ***F41F 1/06*** | (2006.01) |
| *F42B 4/08* | (2006.01) |
| *F42B 10/30* | (2006.01) |

(52) U.S. Cl.

CPC ..... *F42B 4/22* (2013.01); *F41F 1/06* (2013.01); *F42B 4/06* (2013.01); *F42B 4/08* (2013.01); *F42B 10/30* (2013.01)

(58) Field of Classification Search

CPC ..... F42B 4/08; F42B 4/06; F42B 4/22; F42B 4/20

USPC ..... 102/343, 358, 361

See application file for complete search history.

(56) References Cited

U.S. PATENT DOCUMENTS

| | | | | |
|---|---|---|---|---|
| 2,895,063 | A * | 7/1959 | Morris | F42C 11/04 102/207 |
| 5,339,741 | A | 8/1994 | Craven et al. | |
| 6,324,981 | B1 | 12/2001 | Siegler et al. | |
| 6,779,459 | B2 | 8/2004 | Werner | |
| 2002/0083861 | A1 | 7/2002 | Shelton | |
| 2004/0003744 | A1 | 1/2004 | Werner | |
| 2014/0345487 | A1 | 11/2014 | Wu et al. | |

FOREIGN PATENT DOCUMENTS

| | | |
|---|---|---|
| CN | 101813440 | 8/2010 |
| DE | 1257038 | * 12/1967 |
| DE | 10251976 | * 4/2004 |
| DE | 202009006474 | 9/2009 |
| DE | 102011053056 | 2/2013 |
| GB | 11622 | 0/1910 |

* cited by examiner

*Primary Examiner* — Stephen Johnson

(74) *Attorney, Agent, or Firm* — Schlee IP International, P.C.; Alexander R. Schlee

(57) ABSTRACT

Firework accommodating apparatus comprising a shaped body with an upwardly open recess and a first open bore at the bottom in the shaped body, which is situated centrally, wherein a second bore having a smaller diameter is preferably located next to the first bore, wherein in the first bore, preferably a continuous bore or hollow bore, preferably a rod, a so-called guide rod can be fastened and having at least two lateral cylindrical hollow bores in the shaped body or instead of the hollow bores, downwardly inclined wings.

15 Claims, 12 Drawing Sheets

FIREWORK ACCOMODATING APPARATUS COMPRISING GUIDE ROD, FIREWORK AND ELECTRONIC UNIT

BACKGROUND OF THE INVENTION

The invention relates to a firework accommodating apparatus, a firework and a method for launching a firework.

In all effects which come to fruition high in the night sky, it cannot be determined in which direction the stars are ejected. This is left to chance because spherical and cylindrical firework shells rotate about all three axes during the ascent and at the same time can also tumble vigorously and rockets can rotate about the longitudinal axis. The term rolling is used for a rotation about the longitudinal axis.

Since the invention of the firework, pyrotechnicians have made great efforts to make signs, symbols or letters appear in the night sky. So far however, this problem has not been satisfactorily solved.

Spherical and cylindrical shells with signs, symbols or letters have been known for a long time. This kind of shells is called pattern shells. If, for example the firework stars are placed in a heart shape into the burst charge during manufacture of the effect, it is entirely possible to achieve the effect that the stars are also dispersed in a heart shape in the sky. However, the spatial orientation cannot be determined because these firework shells rotate about all three axes during the ascent and in some cases tumble vigorously. As a result of the friction in the mortar during the launching and due to the air resistance in the ascent phase, the spherical and cylindrical shells are frequently set in violent rotation. It is left to chance in which spatial orientation the heart shape is formed. In rare and favourable cases it can be the case that the heart is displayed correctly for the observer at a specific location. Far more frequently however it happens that the heart is upside down for example or that all the firework stars lie one behind the other on one plane and instead of a broad heart shape, only a line can be identified. Typically numerous heart shells must be launched in order to be able to clearly identify a beautiful heart shape from time to time. This constitutes a very high expenditure, and the hearts which appear deformed can reduce the experiential value of a firework. With this technique it is inconceivable to produce letters and whole words in the sky.

In order to improve this problem, hitherto specific obvious measures have been taken to restrict the two undesired degrees of freedom of the rotation. Usually these are purely aerodynamic measures.

One possibility is to use firework rockets instead of spherical and cylindrical shells. Here for example we encounter the so-called shell rockets which can contain the required effect composition with the necessary burst charge. Naturally the rocket only rotates about its longitudinal axis during the ascent. For the example of the heart-shaped arrangement of the firework stars, in each case for example vertical hearts are produced which can be seen either randomly correctly in their full width or with a substantially smaller width or only as a perpendicular line for the spectators who are located at a certain location. Firework rockets in the professional display fireworks field usually have the disadvantage that a very large safety distance is required. In addition, a very large and powerful rocket motor must be used in order to be able to sufficiently accelerate sufficiently large, usually spherical rocket heads. The usually high speed of the rocket ascent in particular at the end of the thrust phase results in the undesired side effect that the effect images are frequently highly distorted.

Another possibility is to attach cables, chains and panels of fabric with or without weights and braking bodies to the spherical and cylindrical shells in order to restrict the degrees of freedom. This is sometimes used with the traditional Maltese firework in order to reduce the undesired rotation and tumbling during the flight path of pattern shells and to optimize the effect image so that the figures tend to be vertical and therefore can be identified correctly in the sky. Here also however there is the problem that the effect cannot always be seen in its full width. Frequently it can only be seen compressed, mirrored and in some cases only as a vertical line for the spectators at a certain location.

It is known from U.S. Pat. No. 5,339,741 (Disney, date of patent: 23 Aug. 1994, filing date: 7 Jan. 1992) that firework shells in the form of a projectile as is used in firearms have better flight properties compared with spherical and cylindrical shells and as a result the precision can be increased. Further described therein is an electronic delay fuse with exact time delay for professional display firework effects in order to increase the precision.

Known from U.S. Pat. No. 6,324,981 (Lacroix, priority: FR/98/01261, 23 Dec. 1998) is a firework with which it is possible to obtain figures, letters or any other signs in the sky. This is made possible according to the prior art whereby the sign is already stored in the firework with which it is to be written in the sky. In this invention the combustible material is in particular formed from a metal powder such as titanium having a granule size greater than 500 μm. The advantage of the metal powder is a particularly homogeneous and durable effect image in the night sky. In addition, aerodynamic measures were taken in this invention: firstly, a projectile-shaped geometry was selected instead of the spherical or cylindrical shape as was already state of the art at this time, and a type of skirt is added by means of a hollow cylindrical continuation with longitudinal slots. Both measures are intended to stabilize the flight path and restrict two degrees of freedom. A problem with this type of firework is that here also it is not ensured that the sign which is to be displayed in the sky can also be perceived as such by the spectators of the firework. Again it is left to chance in which angular position the burst charge ignites and whether the sign can be seen clearly. If a letter such as the horizontally implemented "S" depicted in the patent specification is to be shown, it can certainly occur that this is shown turned through 90° and the spectators at a certain location would rather identify a serpentine line and other letters which do not show the S would for example be turned upside down. If the sign is implemented vertically, it can also be perceived for the spectators as mirrored or having a compressed width or only as a vertical line.

SUMMARY OF THE INVENTION

It is the object of the invention to improve the prior art and in particular provide a firework which shows a letter, a sign, a character or a symbol in the sky with a predetermined orientation in space so that it can be seen and perceived by the spectators as such at a certain location.

The subject matter of the invention is a firework accommodating apparatus comprising a shaped body with an upwardly open recess which preferably has the shape of a hollow hemisphere and a first open bore at the bottom in the shaped body, which is situated centrally, wherein a second bore having a smaller diameter is preferably located next to the first bore, wherein in the first bore, preferably a continuous bore or hollow bore, preferably a rod, a so-called guide rod can be fastened. The first bore preferably has an extension in the form of a hollow cylinder so that the hollow hemisphere and the likewise hollow cylinder together as it were have a funnel shape. On the outer side of the shaped body, preferably at least one, but also 2, 3, 4, 5 or 6 depending on size, lateral cylindrical hollow bores are or can be provided in the shaped body. These hollow bores are preferably at right angles to the longitudinal axis of the shaped body but can preferably also be arranged at a different internal angle of preferably 85°, 80°, 75°, 70°, 65°, 60°, 55°, 50°, 45°, 40°, 35°, 30°, 25°, 20°, 15°, 10° or 5° with respect to the longitudinal axis of the shaped body when it stands on its hollow cylinder and have a closed end so that rocket motors can be arranged therein which after ignition develop thrust forces and let the firework accommodating apparatus according to the invention roll about its longitudinal axis because the hollow bores are arranged offset to the central axis.

DETAILED DESCRIPTION OF THE INVENTION

The shaped body is preferably made of board, papier maché, pressed fibres of natural or synthetic origin, wood, metal or preferably of a plastic such as preferably acrylonitrile butadiene styrene, polyethylene, polyester, polyurethane or any other suitable thermal or thermosetting plastic. Preferably the shaped body is made of degradable plastic or lignin or other degradable plastics of natural or synthetic origin.

Professional display firework effects are used to produce most diverse effects in the night sky. Here principally so-called spherical and cylindrical shells are used and significantly less frequently firework rockets.

All these professional display firework effects usually contain so-called stars in order to produce the desired effect in the night sky. The stars are either rolled according to a very old traditional method in mixing drums. In this case, preferably rice grains, small noodles or small metal balls together with, for example, a mixture of black powder and for example, colouring effect compositions containing metal salts or other colouring substances are added into a mixing drum.

The stars preferably therefore comprise small balls which comprise a charge of preferably black powder with effect compositions such as certain metal salts or other colouring substances which produce specific light and colour effects.

For example, the following colours can be produced by using different chemicals as effect composition:

Red: strontium salts, calcium salts, lithium
Yellow: sodium salts
Green: barium salts, copper, tellurium, thallium, zinc
Violet: caesium, potassium
White, silver: magnesium, aluminium, titanium, zirconium
Gold: iron, carbon Preferably a plurality of different layers can be applied to a rice grain and thus consecutively different effects are possible such as a colour change from red to green to blue.

In addition to the visual effects, additional acoustic effects are also possible such as preferably rattling, crackling, whistling and howling.

The mixing drum is moved until the desired star size is achieved.

Instead of rolling the stars, these can preferably also be pressed. This more modern method is more cost effective and far less time-consuming. However certain effects such as for example a colour change cannot be achieved thereby.

Firework stars are preferably used in spherical and cylindrical shells as well as rockets, Roman candles, single shots, pot à feux (i.e. mines) and cakes in the area of professional display fireworks, and in rockets, Roman candles, single shots, pot à feux and cakes in the area of the end consumer firework. The stars preferably show a light trace after they have been ignited by the explosion of the burst charge and have been ejected in a certain direction. In certain effect genres which have no burst charge, such as pot à feux, the stars are ignited by the lift charge.

Spherical and cylindrical shells are loaded in a mortar and thus shot. These mortars preferably consist of a tube which is open at the top with a closed base on the underside. The mortars are preferably constructed perpendicularly or having a certain inclination with the opening at the top. Usually several mortars are placed in a mortar frame (mortar rack). The mortar racks are then connected, for example by struts so that these stand securely.

A spherical or cylindrical shell preferably has three pyrotechnical compositions or charges with explosive: a lift charge, a burst charge and an effect composition. In the burst charge the firework stars are embedded as effect composition which then produce the light effects in the sky. As a result of the explosion of the lift charge, the spherical or cylindrical shell is driven from the mortar. At the same time, with this process one or, for reasons of redundancy, frequently two or more time fuses or pressed or hammered delay fuses are ignited. Whilst the firework shell ascends, these time fuses burn away. The time fuses are dimensioned so that shortly before reaching the culmination point, the burst charge is ignited. The burst charge substantially has two tasks. Firstly it ignites the firework stars and secondly it accelerates the firework stars so that these are ejected in different directions. Firework stars which are located rather at the centre of the explosion are accelerated less strongly than those located in the outer region. Sometimes a booster charge, the so-called ignition composition, is located at the end of the time fuse in the centre of the firework shell. This ensures that the burst charge is uniformly ignited at the centre.

Rockets preferably consist of an effect composition with burst charge and a rocket motor as well as a guide rod. Rockets are placed in a launching holder. The rocket motor is ignited and produces the thrust for the ascent of the rocket. At the end of the ascent phase the burst charge and therefore the effect composition with the stars is ignited. The stars are ignited and accelerated and expelled in different directions according to the strength of the burst charge. Typically the burn-through of the rocket motor is used for ignition of the burst charge.

Furthermore, non-detonating fuses like quick match and black match can be used. This is an ignition means used in the area of professional display fireworks. A distinction is made between covered and uncovered black match. Covered black match is called quick match. Black match is a fibrous material that is impregnated with black powder suspended in water. In the case of a covered black match, the fibres are covered with paper or plastic film and therefore this burns away very rapidly.

Furthermore, electrical igniters, so-called e-matches, can be used, which are used in many areas of pyrotechnics to ignite pyrotechnic compositions. These are not to be confused with so-called detonators. These are preferably special e-matches which additionally contain a booster charge to trigger the detonation of high explosives. An igniter as used in the area of professional display fireworks preferably consists of a small plate of insulating material on which two electrically conductive tracks are attached. Preferably the two lead-in wires, i.e. the ignition cable are soldered on or welded on one side of the plate. Preferably the electrical connection to a resistance wire is made on the other side. Preferably a small quantity of a suitable pyrotechnic composition is applied to the resistance wire. The e-match is then preferably provided with one or more layers of protective varnish and is thus sealed and can be stressed mechanically and is insensitive to electrostatic discharges. If the e-match has a certain electric current flowing through it, the resistance wire heats up and the pyrotechnic composition in the e-match ignites. This produces sparks and heat with the result that the pyrotechnic composition to be ignited outside the e-match is also ignited. If the electric current through the e-match is sufficiently high, this process takes place abruptly and requires only a few milliseconds.

It is furthermore possible that instead of the e-match, mere resistance wire can be used in order to ignite pyrotechnic compositions and charges. These e-matches manage without a pyrotechnic composition whereby during installation preferably a piece of wire or preferably a coil of resistance wire is brought in close contact with the composition or charge to be ignited or the fuse to be ignited. If sufficient current flows through the wire, this begins to glow and the pyrotechnic material is ignited. It has been known for a long time that in principle any incandescent lamp can quite easily be converted into an e-match by opening the glass envelope and filling with a pyrotechnic composition such as black powder for example. E-matches without a pyrotechnic composition are now also commercially available. These contain a piece of wire or a filament of singly or multiply wound resistance wire such as in used in incandescent lamps. If the current intensities are sufficiently high, the ignition process takes place almost abruptly and requires only a few milliseconds. However, the delay is usually somewhat longer than with conventional e-matches. The advantage of this variant of e-match is that it is not considered to be a hazardous material and can be transported without restriction. Pyrotechnic objects provided with these e-matches are not considered to be primed and may be handled without special additional measures, transported and shipped in containers.

A firework according to the invention preferably has a lift charge, a burst charge, an effect composition, a guide rod, one or more rocket motors and an electronic unit with a sensor for measuring the Earth's magnetic field, an e-match for triggering the lift charge and an e-match for triggering the burst charge. Instead of rocket motors, other thrust-generating devices can be used such as pyrotechnic gerbs with or without nozzles or pressed black powder or other suitable pyrotechnic compositions in a sleeve with or without nozzles or pressurized gases. "Gerb" is the technical term for fireworks fountains. Gerbs generate a jet of sparks.

The firework according to the invention is preferably launched from a mortar, i.e. a tube having a length of preferably 30 cm to 1.5 m, preferably 40 cm, 50 cm, 60 cm, 70 cm, 80 cm, 90 cm, 100 cm, 110 cm, 120 cm, 130 cm, 140 cm. A mortar can preferably be constructed of glass fibre-reinforced plastic, board, steel, aluminium, polyethylene or other thermal or thermosetting plastics.

The mortar used preferably has a bore in the base through which the guide rod of the new type of firework is subsequently pushed.

The guide rod projects out downwards and should not touch the ground.

The mortar is preferably positioned in an elevated position and fixed so that the guide rod can project downwards and in so doing not touch the ground.

Another solution is preferably to provide a base of the mortar with an opening for the guide rod in the centre of the mortar and extend the mortar downwards as shown in the drawing. The mortar pipe can be open at the bottom or be closed by a base. When it is fitted with a base, it can have a closable opening in the base to that the lower pipe piece can be cleaned.

Preferably simple frames can be manufactured for these mortars, similar to those already used hitherto in the professional display firework area.

Alternatively a holder can preferably also be constructed for a single mortar, preferably for example a tripod with standing platforms which uniformly distribute the enormous forces produced during launching over a larger area.

The firework accommodating apparatus according to the invention preferably has a rod at the bottom, a so-called guide rod, where this rod can be fasted in the first bore, which can preferably be a hollow bore. This rod can also preferably be fastened to the firework and be guided through the first bore in the firework accommodating apparatus. The rod, a so-called guide rod preferably comprises a round rod or polygonal rod, preferably a square rod. This has a corresponding length according to the size of the firework which can preferably be 10 cm, 15 cm, 20 cm, 25 cm, 30 cm, 35 cm, 40 cm, 45 cm, 50 cm, 55 cm, 60 cm, 65 cm, 70 cm, 75 cm, 80 cm, 85 cm, 90 cm, 95 cm, 100 cm, 105 cm, 110 cm, 115 cm, 120 cm, 125 cm, 130 cm, 135 cm, 140 cm etc., in 5 cm, steps up to preferably 3 m.

This guide rod is preferably made of board, papier maché, pressed fibres of natural or synthetic origin, wood, metal or preferably of a plastic such as preferably acrylonitrile butadiene styrene, polyethylene, polyester, polyurethane or any other suitable thermal or thermosetting plastic. Preferably the guide rod is made of degradable plastic or lignin or other degradable plastics of natural or synthetic origin.

The firework according to the invention comprises a shaped body. A firework such as preferably a so-called shell is fastened in this shaped body. A shell therefore has a substantially spherical shape where this is preferred and also a cylindrical or any other geometrical shape of the firework is possible. This shell has a similar structure to the firework shells which are already used in the area of professional display fireworks. Typically these are made of two hollow cardboard hemispheres. The cardboard spheres are filled separately from one another with burst charge and effect composition and then rapidly folded together. The two halves are then adhesively bonded to one another. To this end for example, firstly preferably crepe adhesive tape is applied along the gap. Then a cardboard strip coated with paste is preferably applied to the sphere thus formed. The sphere preferably has a layer of cardboard strip glued on all sides in multiple layers and overlapping so that a very stable sphere is formed which is ripped into numerous small fragments upon ignition of the burst charge. The cardboard sphere should therefore preferably not rupture along the gap but at other locations. The fastening of the shell is preferably made by means of an adhesive connection where a screw connection or also a fastening by means of strips would also be possible. Such a shell preferably has a cardboard sleeve. These shells preferably have a calibre of 50, 75, 100, 125, 150, 175, 200, 210, 225, 250, 300 or 400 mm, where however any other calibre in the range of about 20 to about 600 mm can be used. The larger the calibre, the larger is the attainable effect image in the night sky. The ascent height in m approximately corresponds to the calibre in mm. A calibre of 100 mm approximately gives an ascent height of 100 m.

A firework according to the invention has a lift charge which serves to make the firework soar.

This preferably consists of black powder or nitrocellulose powder or other suitable explosives. Explosives such as black powder are advantageous here which react relatively slowly and ensure that the firework is driven out of the mortar without the firework being destroyed. Black powder deflagrates at a speed of 300 to 600 m/s. Preferably an e-match is incorporated in the lift charge which is connected to the electronic unit and can be triggered by this. This can preferably be a conventional e-match or also only a filament of resistance wire.

As is known from conventional firework shells, the black powder is preferably located in a small bag or a piece of thin hose which for example consists of plastic film. This is preferably incorporated around the shaped body and around the guide rod. In order to protect the lift charge from moisture, water and mechanical stressing, and in order to increase safety, this area is preferably wound with several layers of paper or plastic film.

The burst charge also preferably comprises black powder or nitrocellulose powder and is used to ignite the effect charge, i.e. the firework stars. The burst charge preferably consists of rice husks which have been encased with black powder preferably in the ratio of 4 parts of black powder to 1 part of rice husk, or any other suitable burst charge.

The effect composition is embedded in the burst charge.

Preferably an e-match is preferably embedded in the centre of the burst charge, which is connected to the electronic unit and can be triggered by this. This can preferably consists of a conventional e-match or also only of a filament of resistance wire.

In order that the burst charge through-ignites rapidly and uniformly, an ignition composition of black powder or nitrocellulose powder can preferably be incorporated around the e-match or around the filament of resistance wire.

The stars preferably comprise the initially described firework stars which are embedded in the burst charge as is otherwise usual. With these stars figures such as a heart, letters, characters symbols or words can be written in the sky.

In order that the firework according to the invention can function correctly, it is necessary to preferably apply a marking to the firework shell so that this can be installed in the correct position. A preferably bifilar cable protrudes from the sphere due to the incorporated e-match. By means of this cable and by means of small magnets attached to the inner side of the sphere, the position of the incorporated effect composition can preferably be marked and correct assembly thus made easier. Also preferably by means of imaging processes such as X-rays, the inner structure can be made visible after production of the firework shell in order to enable correct assembly.

It must be ensured that during launching which causes high accelerations the stars are not displaced or get mixed up in some way.

A holding apparatus for the stars is preferably for example a styrofoam plate with holes or the stars are rolled in thin paper or flash paper where the aim is that the stars do not get mixed up during launching and the form to be displayed is maintained. During explosion of the burst charge the holding apparatus should burn, be destroyed, the paper or the flash paper should be torn to shreds so that the firework stars can be ejected unhindered in the respective direction (flash paper is nitrated cellulose which burns away very rapidly).

Another possibility for fixing the stars consists in preferably applying a black powder suspension and letting it harden. Conventional adhesives and resins can also be used for this purpose.

Another possibility is to use a material which is combustible and which is arranged in the form of a sign which corresponds to the form of the sign which is to be obtained in the sky. This is achieved according to the invention whereby the sign is arranged in the form of the sign by means of a combustible shaped body such as preferably a cardboard, a wax or thermal or thermosetting polymer, which corresponds to the form of the sign which is to be obtained in the sky. This can preferably be cardboard or preferably foamed plastic such as styrofoam or any other thermal or thermosetting plastic, preferably in the form of a disk which has recesses or holes in the form of the sign which is to be obtained in the sky. Therefore in the case of a heart the recesses are arranged in a heart shape in which the firework stars are inserted.

The possibilities listed above can also be combined with one another.

Typical figures and symbols can preferably be a heart, double heart, Saturn, cube, butterfly or ring as well as double and multiple rings, various star-shaped symbols, such as for example a Mercedes star, laughing face (smiley), cat face and umbrella and very many more.

Typical letters and characters can, for example, be Latin, Cyrillic, Chinese and Japanese letters or characters.

If several of these effects are constructed next to one another and fired simultaneously or with a certain time offset, entire words or sentences can be written in the sky.

Preferably flags and logos can be represented with different-coloured firework stars. The colour is determined by the chemical composition. Using red and white stars, for example, a pixel matrix could be displayed which shows the Swiss flag for example. The stars can produce an arbitrary image since each star functions as a pixel on a screen where the image is initially small and increases continuously until all the stars are burnt away.

The stars can preferably be inserted two-dimensionally in a position or also three-dimensionally in the firework shell. For example, the three-dimensional variant can be used for the symbol "cube" where the stars are arranged along the 12 edges of the cube.

If a letter is to be displayed, for example, this letter can be incorporated in the firework shell in the subsequently desired orientation. If the public is located far away or the letter should be recognizable at a large distance, it is possible to incorporate the letters vertically. At a normal distance an angle of for example 45 degrees is suitable. If the public is very close to the launch site, the horizontal incorporation is advantageous.

Both rolled, pressed and also cast stars can be used.

In order to increase the ignitability of the stars, these can preferably be rolled in black powder dust before incorporation or they are preferably provided with a coating based on black powder.

According to the invention, a firework accommodating apparatus is provided which comprises a shaped body having a recess open at the top, i.e. which preferably has the form of a hollow hemisphere and a first open bore at the bottom in the shaped body, which is centrally located, wherein a second bore having a smaller diameter is preferably located next to the first bore, wherein a rod, the so-called guide rod, can be fastened in the first bore, wherein this bore can also preferably be a hollow bore. If this bore is continuous, the guide rod can also be fastened to the firework and guide through the first bore in the firework accommodating apparatus.

The first bore preferably has an extension in the form of a hollow cylinder so that the hollow hemisphere and the likewise hollow cylinder together as it were have a funnel shape. On the outer side of the shaped body, preferably at least one, but also 2, 3, 4, 5 or 6 depending on size, lateral cylindrical hollow bores are or can be provided in the shaped body. These hollow bores are preferably at right angles to the longitudinal axis of the shaped body but can preferably also be arranged at a different internal angle of preferably 85°, 80°, 75°, 70°, 65°, 60°, 55°, 50°, 45°, 40°, 35°, 30°, 25°, 20°, 15°, 10° or 5° with respect to the longitudinal axis of the shaped body when it stands on its hollow cylinder and have a closed end so that rocket motors can be arranged therein which after ignition develop thrust forces and let the firework accommodating apparatus according to the invention roll about its longitudinal axis because the hollow bores are arranged offset to the central axis. Instead of rocket motors, other thrust-generating devices can be used such as pyrotechnic gerbs with or without nozzles or pressed black powder or other suitable pyrotechnic compositions in a sleeve with or without nozzles or pressurized gases.

The shaped body is preferably made of board, papier maché, pressed fibres of natural or synthetic origin, wood, metal or preferably of a plastic such as preferably acrylonitrile butadiene styrene, polyethylene, polyester, polyurethane or any other suitable thermal or thermosetting plastic. Preferably the shaped body is made of degradable plastic or lignin or other degradable plastics of natural or synthetic origin.

An angular momentum is formed by the rocket motors being arranged outside the central axis. The direction of rotation is preferably predetermined by the arrangement of the rocket motors and the associated direction of thrust. These rocket motors are preferably ignited simultaneously with the ignition of the lift charge by the hot burn-up products and the enormous pressure as it were by the lift charge but they can also preferably be ignited individually and separately by the lift charge. Preferably the rocket motors can also have a coating which promotes their ignition.

Preferably the rotational speed increases during the ascent of the firework. Initially the rotational speed is very low on account of the inertia. This increases continuously as long as the rocket motors deliver thrust.

Located in the interior of the shaped body in the centre is preferably a recess, preferably in hexagonal form into which such a shaped apparatus can be placed. Preferably the apparatus is an electronic module for example in the form of a printed circuit board.

For the function of the new type of firework it is important that this electronic unit is installed in a certain orientation to the effect composition. For this purpose, for example markings are preferably provided on the printed circuit broad which indicate how the firework shell together with the electronic unit must be installed. Preferably also a notch can be provided in the printed circuit board and preferably a lug in the shaped body and a lettering of the shaped body so that the correct assembly is facilitated or forced.

This electronic module preferably consists of a printed circuit board with preferably a microcontroller with preferably at least one communication interface, diverse inputs and outputs, so-called ports, at least one analog input and preferably at least one sensor for determining the Earth's magnetic field as well as all the necessary components for storing electrical energy and as well as preferably a voltage regulation and an oscillator for producing the clock frequency for the microcontroller. Furthermore, this module through suitable programming is capable of evaluating the sensor signals and calculating the correct time of ignition of the burst charge. The sensor or the sensors for determining the Earth's magnetic field enable the electronic unit to determine at any time during the ascent phase the position in which the firework is specifically located with respect to the Earth's magnetic field.

Furthermore, the electronic unit is connected to an external control unit preferably via a cable.

The electronic unit is capable of receiving the command for launching and of initiating the launch itself.

As soon as the firework has been launched, there no longer any possibility of supplying the electronic unit with electrical energy from outside. Thus, preferably capacitors are used which are preferably charged before launching and supply the electronic unit with power during the ascent until the burst charge is ignited.

Preferably three capacitors are used. The first capacitor should preferably supply the electronic unit and in particular the microcontroller with electrical energy. The second capacitor should preferably store energy which is required to safely trigger the e-match of the lift charge. It would also be possible to trigger the lift charge by means of energy provided externally. However, it is advantageous to buffer the energy in a capacitor since significant voltage drops can occur with long cable runs with small conductor cross-sections. The third capacitor should preferably store the energy required to safely trigger the e-match of the burst charge.

The electronic unit is preferably programmed with various parameters before launching. Preferably these data are stored in a non-volatile manner in the electronic unit for example in a flash or EEPROM memory so that these are available unchanged even after interruption of the power supply. These data can preferably be programmed either already during manufacture of the electronic unit or at any other time such as, for example, shortly before use.

Preferably a time window is programmed within which the ignition of the burst charge should take place. The height is preferably related to the time, i.e. the time after which the respective firework has reached its minimum height is known after which ignition is safe for the spectators and the surroundings and the effect is clearly visible. Furthermore, the time after which the respective firework has reached the culmination point is also known. The upper limit of the time window should be selected so that the culmination point is not reached. The firework should be ignited in any case before this begins to fall back to the earth. Otherwise it cannot be guaranteed that the sign will be correctly displayed and in extreme cases the firework would fall back to the Earth's surface as a so-called "black shell".

The time window depends strongly on the calibre used, i.e. the diameter of the firework.

The electronic unit in the firework is therefore substantially programmed with the following parameters:

- lower limit of the time window for ignition of the burst charge, this corresponds to the minimum height
- upper limit of the time window for ignition of the burst charge, this corresponds to the maximum height,
- angle with respect to the north-south axis, for example at which the burst charge should be ignited.

Furthermore, the time window and the roll rate is preferably determined so that the firework during the time window preferably executes at least one complete rotation about the longitudinal axis so that each angular position is achieved. Preferably however the system is tuned so that several rotations can take place within the time window. It is thus achieved that ignition takes place shortly after reaching the minimum height and that several fireworks of this design which are ignited simultaneously are also burst approximately simultaneously.

Furthermore the electronic unit is preferably programmed with the angular deflection with which the sign should be displayed subsequently. Since a type of electronic compass is used here, it is preferably possible to use the north-south axis as a reference quantity where however theoretically any other reference quantity can also be used. If the north-south axis is used and the angular deflection is programmed as 90°, this means that spectators located to the south of the launch site can perceive the sign in its full width and correctly oriented in the night sky.

The power supply and communication with the control unit can preferably take place via a common cable or via two different cables. The common cable can here preferably only have two cores.

During the launch the cable connection is preferably interrupted. This can preferably be used for detection of the launch. The ignition of the burst charge preferably only takes place when the cable interruption has been detected at the correct time.

The capacitor which provides the ignition energy for triggering the lift charge and the capacitor which provides the ignition energy for triggering the burst charge can preferably only be charged when the control system is armed and the information "armed" is transmitted to the electronic unit in the firework in order to increase the safety. The charging of these ignition capacitors can preferably only take place shortly before an impending launch, i.e., for example five seconds before the launch in order to likewise increase the safety.

The charging voltage of the capacitors can preferably be measured by means of an analogue/digital converter and thus be monitored continuously by the microcontroller. The launch more appropriately only takes place when the charging voltage is sufficiently high in order to ensure that both the lift charge and also the burst charge can be safely ignited.

Conversely these capacitors can be intentionally discharged when the control system is disarmed. The charging state of the ignition capacitors can preferably be monitored in order to increase the safety. It is thereby possible to display to the user that the ignition capacitors are discharged and that people can safely approach the mortar in order to unclamp the firework and unload it from the mortar.

By means of several resistors which are connected in parallel to the various capacitors (main capacitor for the power supply, ignition capacitor for the lift charge, ignition capacitor for the burst charge), it can be ensured that the capacitors are discharged automatically within a few minutes when the cable connection is interrupted in order to increase safety.

Instead of a single discharging resistor, preferably two or more resistors can be connected to ensure safety if one resistor should be defective.

Preferably a sensor for measuring the earth's magnetic field is located in the electronic unit. In principle, this is an electronic compass. The sensor is installed in relation to the firework stars in a predetermined orientation so that it is possible for the microcontroller to determine the spatial orientation of the symbol or letter to be displayed by means of the time of ignition of the burst charge. Furthermore the sensor is installed so that it principally measures the horizontal component of the earth's magnetic field with respect to the earth's surface and thus the reference to the north-south axis can be determined.

In order that the electronic unit can fire the lift charge, an e-match is preferably installed in the lift charge which is preferably connected to the electronic unit. The ignition cables of this e-match are preferably laid in the second bore having a small diameter in the shaped body. The bore is preferably sealed by suitable materials, preferably an adhesive so that during the launch hot combustion products are prevented from passing through the bore from the lift charge into the chamber with the electronic unit and possibly further as far as the burst charge.

As soon as the electronic unit receives the command for launching from the control unit, the lift charge is fired but only when all conceivable input conditions are satisfied. These include, for example, the sufficient charging of all the capacitors, an efficient data connection to the control unit and the appropriate programming of the firework with the required parameters.

With the ignition of the lift charge it is detected whether the firework has left the mortar. This is preferably accomplished by detection of the separation of the cable connection at the correct time immediately after ignition of the lift charge.

If it was identified that the launch has not taken place, the process is preferably interrupted to avoid a non-starter. In such a case the capacitors are specifically discharged relatively rapidly in order to create a safe operating state for removal of the firework from the mortar.

With the successful launch, preferably an elapsed time meter is started in the electronic unit. This is used to control the time sequence taking into account the programmed parameters.

If the launch is successful, detection of the measured values of the Earth's magnetic field sensor is preferably started in order to continuously determine the rate of rotation and the angular position of the longitudinal axis of the firework relative to the example of the north-south axis.

As soon as the lift charge is fired, the firework ascends and is set in rotation about the longitudinal axis with a predetermined direction of rotation by the rocket motors. On account of the inertia, the rotational speed increases during the ascent whilst the rocket motors continuously deliver a relatively uniform thrust.

Through continuous measurement of the signal of the Earth's magnetic field sensor, the software (firmware) of the electronics preferably continuously calculates the instantaneous speed of rotation, i.e. the angular velocity. From this the spatial orientation can be derived at each time point.

During the ascent the sensor preferably delivers an approximately sinusoidal signal whose maxima and minima show the north-south alignment and the south-north alignment. The frequency corresponds to the rotational speed. The time between two minima or maxima is a period and this time precisely corresponds to a revolution. Half this time corresponds to a half-rotation. A quarter of this time corresponds to a quarter rotation etc.

This method can be used to calculate the current angular speed and angular position at any time point.

During this ascent phase, i.e. in the time between the launch and reaching the lower limit of the time window, the electronic unit preferably therefore evaluates the signals of the Earth's magnetic field sensor and thereby determines the current rate of rotation and thus also the current angular velocity of the firework.

As soon as the lower limit of the time window is reached, the optimal ignition time can be calculated by means of the current angular velocity.

In particular at higher rates of rotation small time delays can have a negative effect on the correct representation of the sign in the night sky. A time delay principally arises as a result of the e-match causing a certain delay of a few milliseconds. The ignition time should therefore be moved slightly forwards according to the ignition delay by incorporating a correction factor in the calculation depending on the current rate of rotation.

When the optimal ignition time is reached, the burst charge is preferably fired. For this purpose an e-match is preferably located in the centre of the burst charge. This e-match is preferably connected via a cable to the electronic unit. This cable can be laid in manifold ways such as preferably in a sleeve inside the firework shell and preferably in a bore inside the shaped body. In order to increase safety, preferably the sleeve and the second bore are sealed with a suitable material such as preferably an adhesive so that there is no risk of premature ignition. The cable can however also preferably be guided externally along the firework shell and guided into the burst charge at any position.

In order to promote ignition of the burst charge and in order to ensure a uniform through-ignition, the burst charge can preferably be provided with an additional ignition charge such as black powder dust or granules.

The sign or the letter now appears in the correct orientation in space so that the spectators can see and identify this clearly and correctly oriented at a certain location.

Fragments of the sleeve of the firework shell fall to the ground. Likewise the guide rod and the shaped body.

If the electronic unit should not be in a position to reach a suitable ignition time during the flight phase, for example, the Earth's magnetic field sensor does not deliver a signal as a result of a defect, ignition of the burst charge preferably takes place in each case on reaching the upper limit of the time window in order to prevent a so-called "black shell".

The following appropriate configurations of the invention are feasible and the following further developments are possible:

Instead of conventional e-matches which contain pyrotechnic material, preferably a purely electrical ignition is possible, whereby ignition takes place due to the evolution of heat by means of the voltage applied to a glow wire. The glow wire preferably consists of a piece of wire or preferably comprises single or multiple coils which rapidly begin to glow and ignite the respective charge, i.e. either the lift charge or the burst charge. If the firework is fitted with these glow e-matches, it is not deemed to be primed and may be transported by road or sea. Typically these e-matches have a somewhat longer ignition delay which can be taken into account when calculating the ignition time.

In order to increase the amplitude of the output signal of the magnetic field sensor, the active area of the sensor can preferably be mounted obliquely to the longitudinal axis of the firework and thus be adapted to the angle of inclination of the Earth's magnetic field prevailing on site.

In order to identify spinning movements or other abnormalities in the flight path of the firework, a second magnetic field sensor can preferably be installed whose active area is aligned horizontally to the longitudinal axis of the firework so that the magnetic field component perpendicular to the Earth's surface is also detected.

The method for safe detection of the launch can be supplemented by the following measures:

For safe detection of the launch the signal of the magnetic field sensor can preferably additionally be used and it can be investigated whether the rotational speed, i.e. the frequency, increases with time. It can also be investigated whether the sensor delivers a sinusoidal signal.

For safe detection of the launch the signal of a thermistor which is attached to the underside of the shaped body can preferably additionally be used. It can be investigated whether the temperature has suddenly increased due to ignition of the lift charge.

For safe detection of the launch the signals of preferably up to three acceleration sensors for up to three axes and the signals of up to three gyroscopes for up to three axes can be additionally used which are integrated in the electronic unit.

Instead of a plurality of capacitors, preferably a central capacitor can also be used which delivers the energy for operation of the electronic unit and the energy for ignition of the lift charge and the burst charge.

Instead of standard electrolyte or tantalum capacitors, preferably capacitors having an extremely high capacitance, so-called double-layer capacitors can also be used.

For storage of electrical energy and for operation of the electronic unit and for triggering the e-matches, preferably batteries or rechargeable batteries, i.e. primary or secondary elements, can be used instead of capacitors.

Instead of a microcontroller, preferably a microprocessor can also be used. In this case, preferably further components are required inside the electronic unit: RAM, ROM, EEPROM, port components and analogue/digital converters.

The electronic unit can also preferably be attached under a protective cover to the tip of the firework or at another suitable location.

Communication between the external control unit and the electronic unit can take place by means of a cable preferably in manifold ways: by radio, by inductive or capacitive coupling, by ultrasound or by optical coupling by means of visible or invisible light of any wavelength in free space or by means of light guides. The connection can preferably be made with or without data exchange. Data exchange can preferably be unidirectional or preferably bidirectional. The connection to the control unit can preferably be with or without power or energy supply of the electronic unit in the firework.

Instead of a single firework, preferably a plurality of these fireworks can be operated on a common communication means such as, for example, a cable. This network can have different topologies. This includes substantially preferably the network topologies line, bus, star, tree or ring as well as meshed or fully meshed.

If a plurality of fireworks are operated within a network, it can preferably be ensured by means of suitably applied strain relief that during a launch with separation of the connection to the network the remaining network remains intact and operational.

Instead of a guide rod, preferably a projectile-shaped firework shell similar to the shape of a profile of a firearm with an empennage or another suitable geometrical shape is possible where the empennage preferably influences and predefines direction of rotation and rotational speed.

The firework could preferably be cylindrical or projectile-shaped and have grooves turned on the outer side so that during launch from the mortar a twist having a certain direction of twist with a certain twisting speed is formed. The rotational speed profile thus changes. At the beginning of the flight phase this is high and decreases continuously with time.

The firework could preferably be cylindrical or projectile-shaped and the mortar could preferably have features such as helical grooves in order to set the firework in rotation, in order to impart a twist to the firework and also as in firearms a barrel with features is used to impart a twist to the projectile. The rotational speed profile thus changes. At the beginning of the flight phase this is high and decreases continuously with time.

The firework could preferably be cylindrical or projectile-shaped and the mortar could have a polygonal structure twisted into itself similar to a helix in order to impart a certain twist to the firework and also as in firearms a polygonal barrel is used to impart a twist to the projectile. The rotational speed profile thus changes. At the beginning of the flight phase this is high and decreases continuously with time.

A further subject matter is a method for launching a firework according to the invention, wherein the firework is inserted in a mortar for launching which is positioned and fixed in an elevated position so that the guide rod of the firework can project downwards and in so doing not touch the ground.

Preferably the firework according to the invention is inserted in a mortar for launching which has a base with an opening for the guide rod in the centre of the mortar and that the mortar tube is to be extended downwards, wherein the mortar tube is open at the bottom or can be closed by a base wherein when it is fitted with a base, it can have a closable opening in the base so that the lower tube piece can be cleaned.

Preferably the firework according to the invention is inserted in a mortar for launching, which has features such as preferably helical grooves or the mortar has a polygonal structure in order to set the firework in rotation.

The guide rod can preferably have a fold-out empennage at the end where the empennage influences the direction of rotation and the rate of rotation.

The empennage could also preferably be located at the upper end, i.e. the tip of the firework.

Instead of a lift charge of pyrotechnic material, the firework could preferably also be driven from the mortar by means of compressed air or other pressurized gases. If gases are used, these can also be present in liquefied form. By opening a valve, the vapour pressure of the gases can be used to drive the firework from the mortar.

In order to increase safety and reliability, there are a plurality of possibilities for achieving a redundancy.

In addition to the electronic unit, preferably one or more pyrotechnic time delays, preferably ignition cords could be incorporated which are preferably ignited by the lift charge and the delay of which is determined so that the burst charge is approximately ignited at the culmination point if the electronic unit should fail.

The ignition capacitors and the output transistors could preferably be duplicated so that ignition takes place nevertheless in the event that a circuit part should fail.

Preferably two or more magnetic field sensors could be provided so that the firework can still function correctly should a sensor be defective.

In addition to the electronic unit, another independent electronic unit could preferably be provided which represents an electronic ignition delay with pre-set time. If the main unit should fail, the second electronic unit would fire the burst charge and specifically approximately when the culmination point is reached. The ignition signals of both units could be guided by means of diodes to a common e-match in the burst charge.

In addition to the electronic unit, preferably another independent electronic unit could be provided which functions identically and has two independent e-matches. If the first electronic unit should fail, the second electronic unit would fire the burst charge at the correct time.

The data transmission between the control unit and the electronic unit in the firework can preferably be made particularly secure by using protocols with checksums with cyclic redundancy checking (CRC) and encryption such as AES.

If it is advantageous, a piece of quick match can be installed between the e-matches and the respective charges. The additional delay time due to the quick match can be taken into account when calculating the ignition time of the burst charge.

The guide rod and the plastic shaped body could preferably contain explosive in cavities which for example are fired together with the burst charge and destroy these parts so that only small fragments fall to the ground which pose no danger.

Another alternative is that the guide rod and the plastic shaped body is preferably equipped with a parachute which is ejected so that these parts glide slowly and safely to the ground after ignition of the burst charge.

Preferably both rolled and pressed firework stars can be used. The latter are usually cylindrical.

Instead of the stars, preferably metal powder or granules in any grain size as well as other powders or granules which produce colour effects in any grain size as well as carbon in all available forms can be used which oxidizes in air and produces a luminous effect with the result that a more homogeneous effect image can be produced. The powder and granules can be pressed or loose.

In order to increase the effect preferably one or more firework stars can be attached externally in the upper region of the firework. These are ignited during launch by the hot combustion products and produce a spark tail during ascent. This effect is known as a so-called palm in the area of professional display fireworks. The tail forms the palm trunk. Firework stars draw the palm leaves in the night sky.

The pyrotechnic composition in the rocket motors can preferably be enriched with an effect composition. This can increase the visual and acoustic effect.

The following alternative solution approaches are feasible.

If the rocket motors are preferably aligned somewhat downwards, so that upward thrust is produced, an effect similar to a firework rocket can be produced where the thrust of the rocket motors makes the firework ascend. Thus, a mortar and the lift charge could preferably be dispensed with.

One alternative, instead of the hollow bores and the rocket motors or in addition to the hollow bores and the rocket motors, is to attach downwardly inclined wings to the shaped body. These wings can be attached in a number of 1, 2, 3, 4, 5, 6, 7, 8, 9 or 10 and during the ascent phase also have the result that the firework rolls about the longitudinal axis in a predetermined direction of rotation.

Preferably one to three acceleration sensors for up to three axes and one to three gyroscopes for up to three axes can be present and evaluated in order on the one hand to compare the typical acceleration values with the actual one and verify the successful launch and correct ascent. This sensor can preferably be additionally evaluated during the entire flight path in order to increase the safety and precision. By means of this so-called inertial navigation, in some cases preferably magnetic field sensors, guide rod, shaped body and rocket motors can be entirely dispensed with. The electronic unit would then sit inside a, for example, preferably spherical or cylindrical firework shell and the firework shell would rotate in all degrees of freedom and be ignited at the suitable time.

Preferably the shaped body can determine its position in three-dimensional space by evaluation of radio signals of communication or navigation satellites. By evaluating radio signals of communication or navigation satellites, inertial navigation, magnetic field sensors, guide rod, shaped body and rocket motors could preferably be dispensed with. The electronic unit would then sit inside a, for example, preferably spherical or cylindrical firework shell and the firework shell would rotate in all degrees of freedom and be ignited at the suitable time.

If the electronic unit should not trigger the launch itself, the ignition of the lift charge can preferably take place conventionally by means of a built-in e-match which is connected to the firing system or by hand by means of a fuse such as quick match. In this case, the electronic unit must identify the launch preferably for example by means of the temperature and acceleration sensors or by means of the magnetic field sensor.

In the simplest case, the electronic unit is preferably notified by applying a voltage to two lines that the launch should be initiated. In this simplest case the control unit is preferably a simple voltage source such as a battery or a rechargeable battery or any arbitrary already existing firing system for pyrotechnics. The capacitors can also be charged with this as described and after a certain time, when this process has safely been completed, i.e. for example after five seconds, the lift charge can be ignited by the electronic unit and the entire sequence up to ignition of the burst charge can be started.

The functional principle described here can also be applied to different firework effect genres. This includes preferably parachute shells, girandolas, i.e. rising crowns and rockets.

The invention makes it possible to provide in a surprising manner a professional display firework effect with an electronic unit for producing two- or three-dimensional figures, letters, characters, digits, numbers, flags, logos and symbols in the sky where the time of bursting and therefore the effect height as well as the position and orientation in space can be determined.

BRIEF DESCRIPTION OF THE DRAWINGS

FIGS. 7 and 7-1 show longitudinal sections of the firework accommodating apparatus according to the invention from the side;

DETAILED DESCRIPTION OF THE DRAWINGS

FIG. 1

Figure 1:
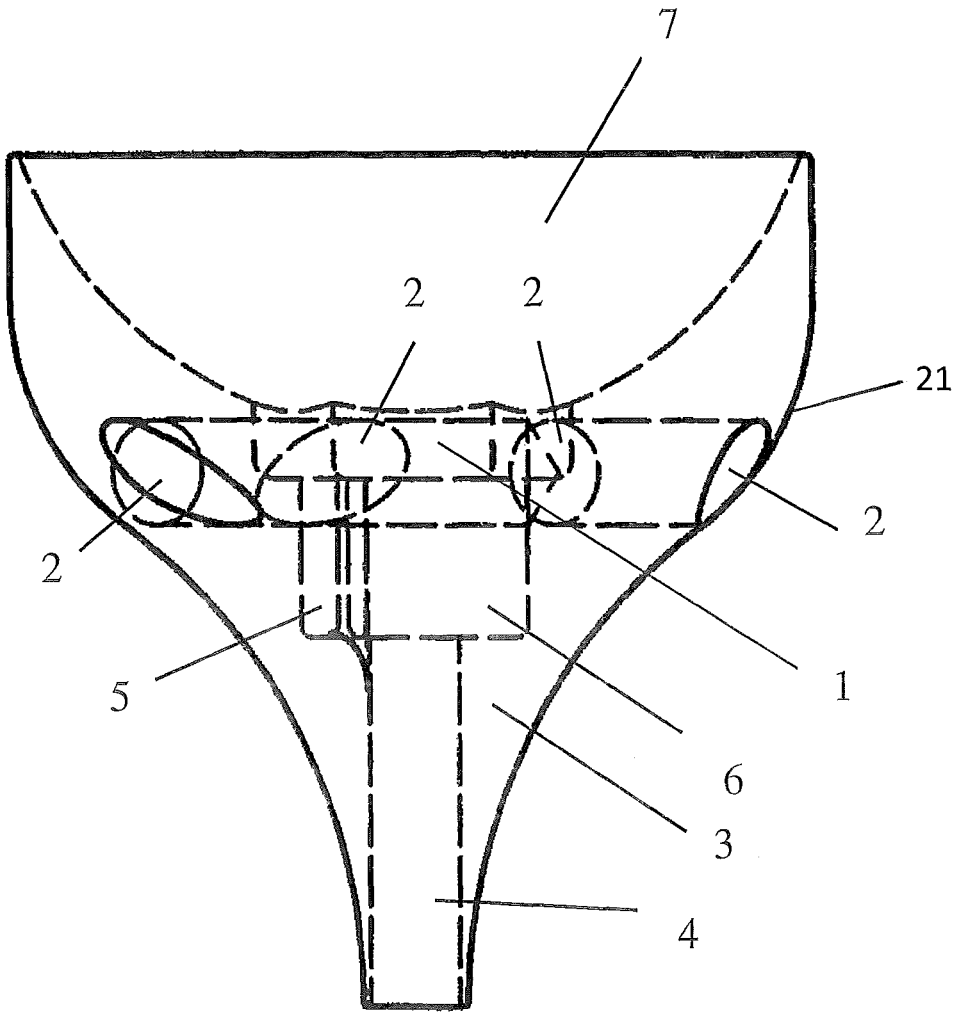
FIGS. 1 and 1-1 show a longitudinal section of the firework accommodating apparatus according to the invention.
Figure 1:
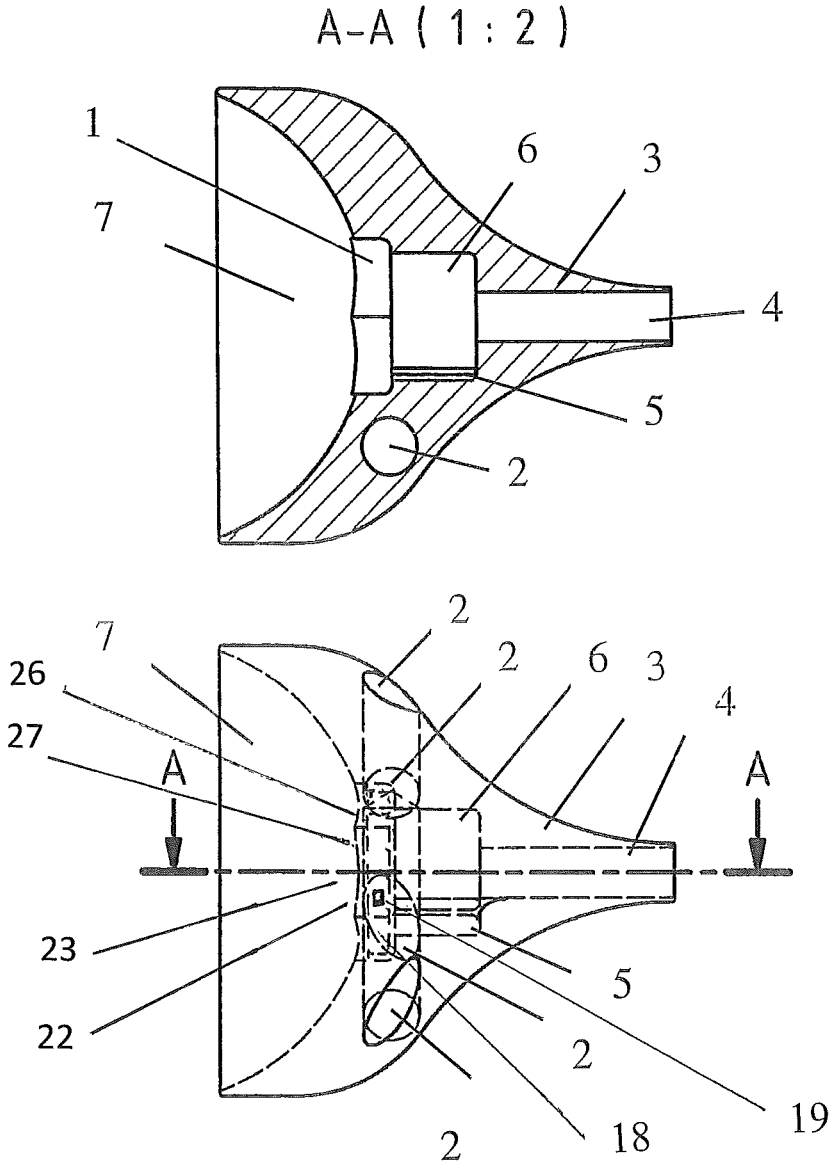

FIG. 1 shows the firework accommodating apparatus according to the invention in longitudinal section, where the funnel-shaped structure can be seen. Here is the recess 7 as well as three lateral cylindrical hollow bores 2 in the shaped body as well as the first centrally located bore 4 in which the guide rod can be inserted, wherein this first bore 4 is located inside the cylindrical extension 3 of the firework accommodating apparatus, wherein the second bore 5 having a smaller diameter through which the supply line for the e-match can be guided is located at the edge of the hexagon 1 recess 6. According to one alternative, instead of the hollow bores 2, the shaped body has at least two downwardly inclined wings 21.

FIG. 1-1

FIG. 1-1 shows the firework accommodating apparatus according to the invention in longitudinal section, where the funnel-shaped structure can be seen. The upper figure is the section A-A of the lower figure. Here is the recess 7 as well as lateral cylindrical hollow bores 2 in the shaped body as well the first centrally located bore 4 in which the guide rod can be inserted, wherein this first bore 4 is located inside the cylindrical extension 3 of the firework accommodating apparatus, wherein the second bore 5 having a smaller diameter through which the supply line for the e-match can be guided is located at the edge of the hexagon 1 followed by the recess 6. The recess 6 adjoins a hexagonal recess 8 in which an electronic unit 18 with a sensor 19 for measuring the Earth's magnetic field is accommodated. The electronic unit further comprises capacitors 26, as well as a flash and EEPROM memory 27 and an apparatus 23 to set the time of firing.

FIG. 2

Figure 2:
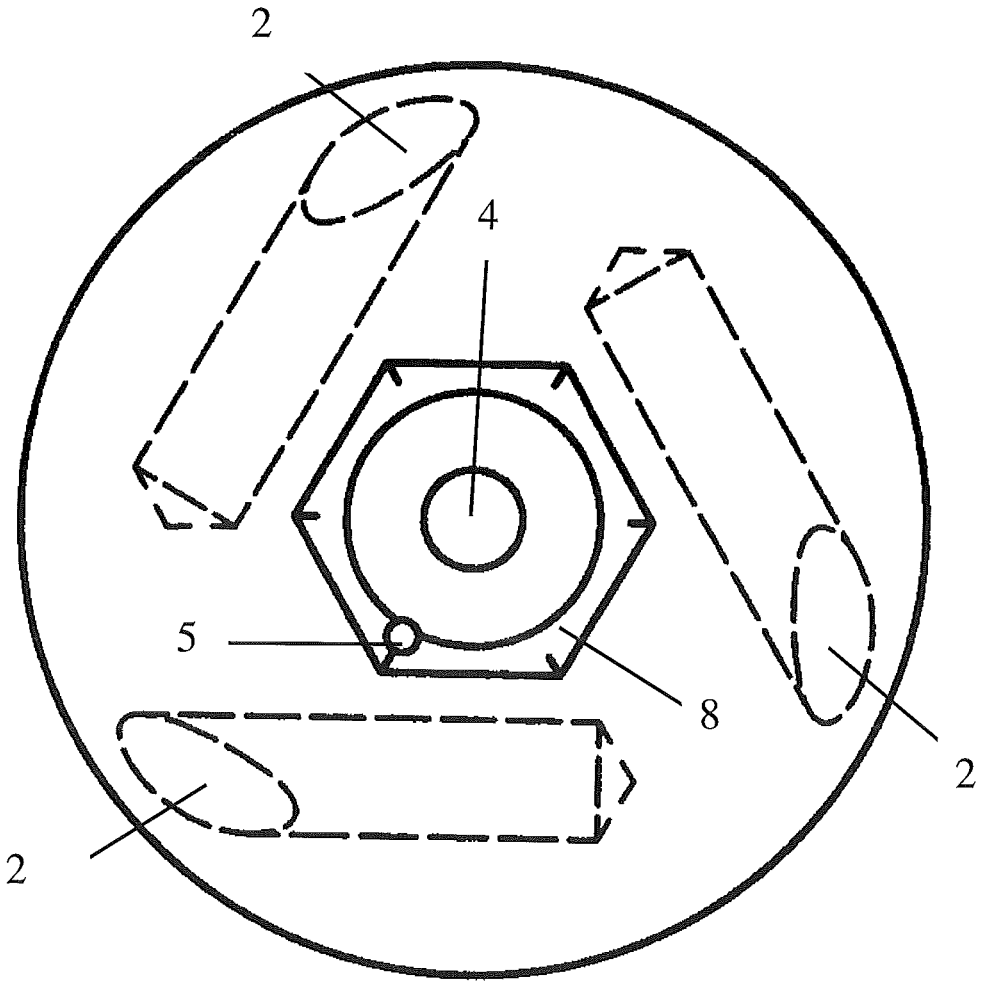
FIG. 2 shows a top view of the firework accommodating apparatus according to the invention.

FIG. 2 shows the firework accommodating apparatus according to the invention viewed from above, where the three lateral cylindrical hollow bores 2 in the shaped body as well the first centrally located bore 4 in which the guide rod can be inserted, wherein this first bore 4 is located inside a hexagonal recess 8 in which the electronic unit 18 with a sensor 19 which may include first and second magnetic field sensors 22 for measuring the Earth's magnetic field (see FIG. 1-1) is located, wherein the second bore 5 having a smaller diameter through which the supply line for the e-match can be guided is located at the edge of the hexagonal recess 8.

FIG. 3

Figure 3:
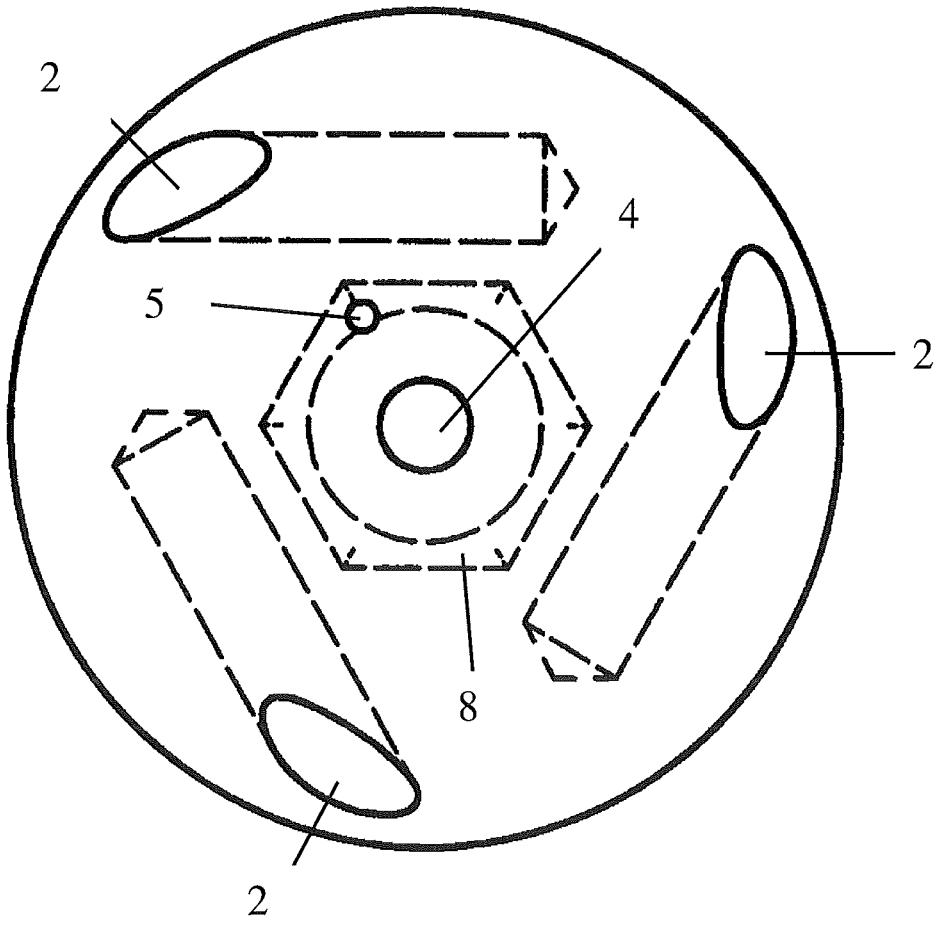
FIG. 3 shows a bottom view of the firework accommodating apparatus according to the invention.

FIG. 3 shows the firework accommodating apparatus according to the invention viewed from below, where the three lateral cylindrical hollow bores 2 in the shaped body as well the first centrally located bore 4 in which the guide rod can be inserted, wherein this first bore 4 is located inside a hexagonal recess 8 in which an electronic unit can be disposed, wherein the second bore 5 having a smaller diameter through which the supply line for the e-match can be guided is located at the edge of the hexagonal recess 8.

FIG. 4

Figure 4:
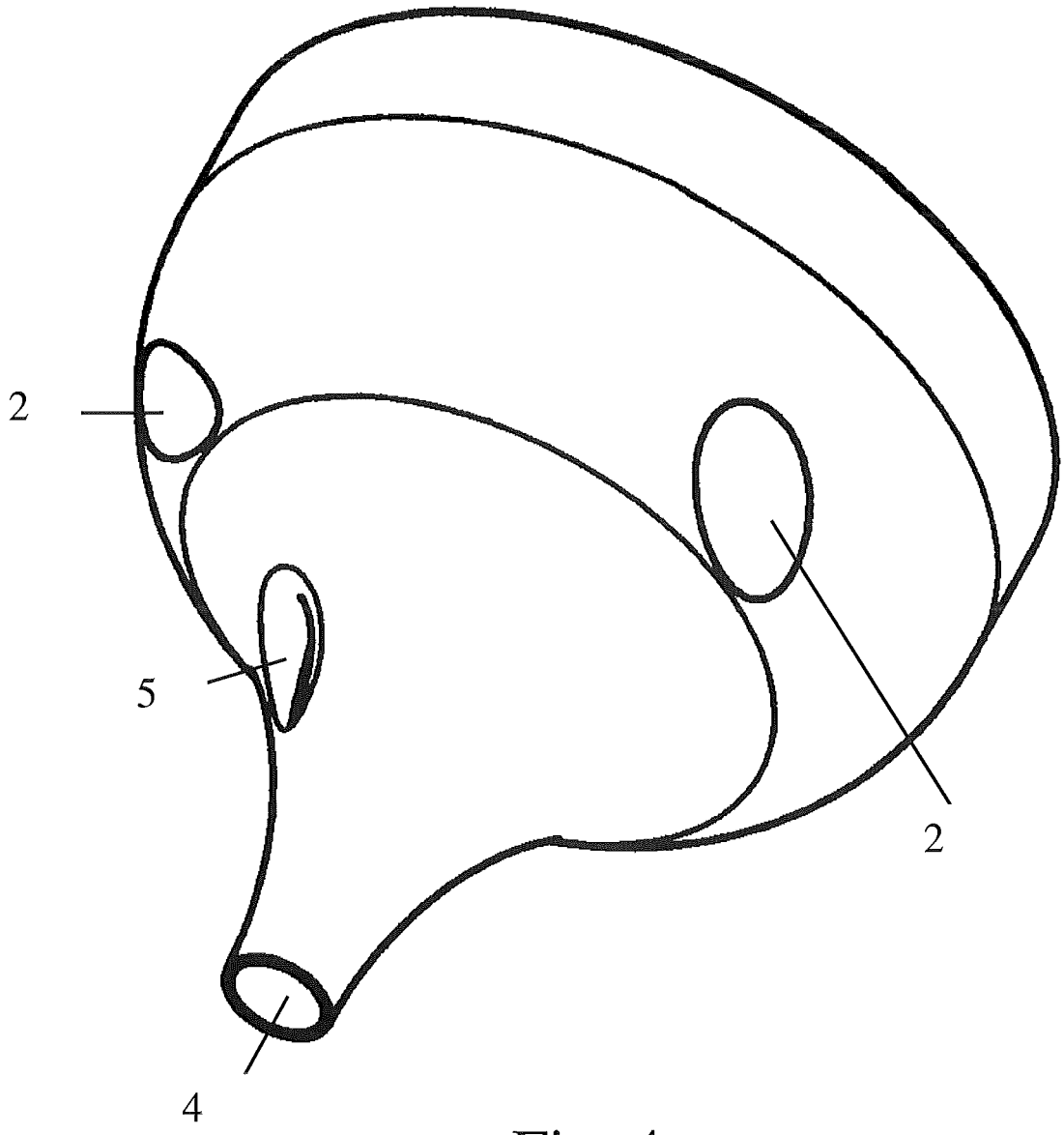
FIG. 4 shows a perspective view of the firework accommodating apparatus according to the invention.

FIG. 4 shows the firework accommodating apparatus according to the invention in perspective view, where the funnel-shaped structure can be seen, wherein two lateral cylindrical hollow bores 2 in the shaped body as well the first centrally located bore 4 in which the guide rod can be inserted, wherein this first bore is located inside the cylindrical extension 3 of the firework accommodating apparatus.

FIG. 5

Figure 5:
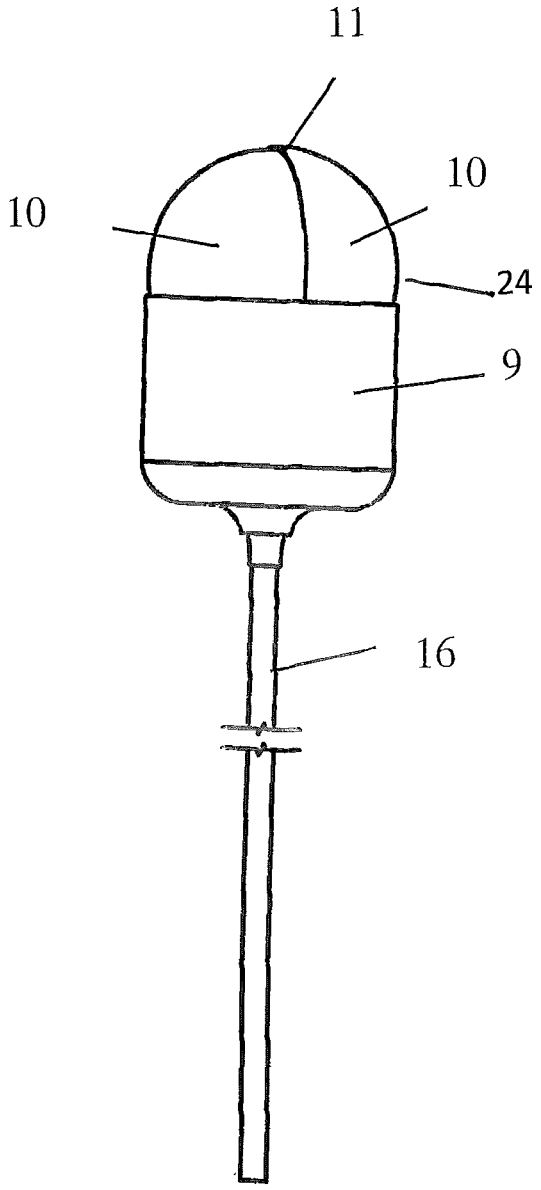
FIGS. 5 and 6 show side views of the firework accommodating apparatus according to the invention.

FIG. 5 shows the firework accommodating apparatus according to the invention 9 from the side in plan view, where the firework accommodating apparatus according to the invention 9 with firework comprising a burst charge 24, two hemispheres 10 and the connecting line 11 between the two hemispheres 10 and guide rod 16 can be seen.

FIG. 6

Figure 6:
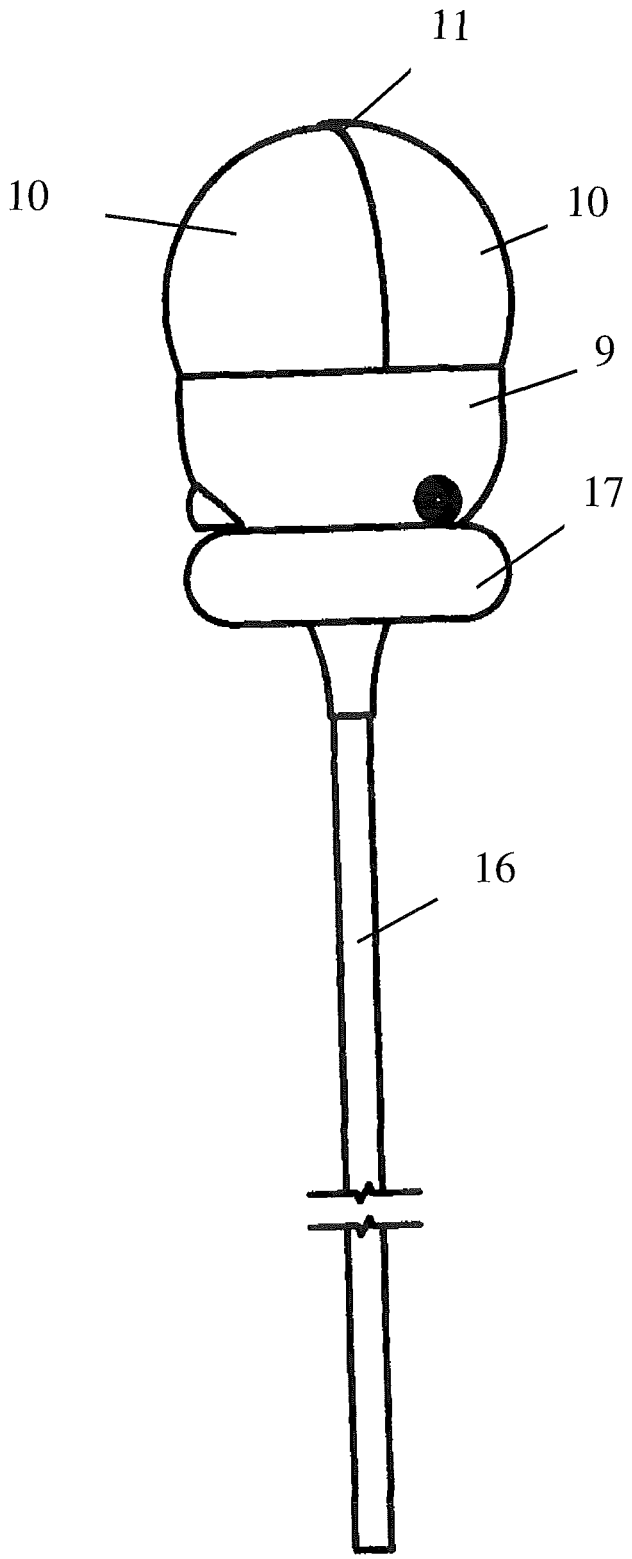

FIG. 6 shows the firework accommodating apparatus according to the invention from the side in plan view, where the firework accommodating apparatus according to the invention 9 with firework comprising two hemispheres 10 and the connecting line 11 between the two hemispheres 10 and guide rod 16 can be seen, wherein in addition the lift charge 25 located in a hose 17 placed around the firework accommodating apparatus 9 can also be seen.

FIG. 7

Figure 7:
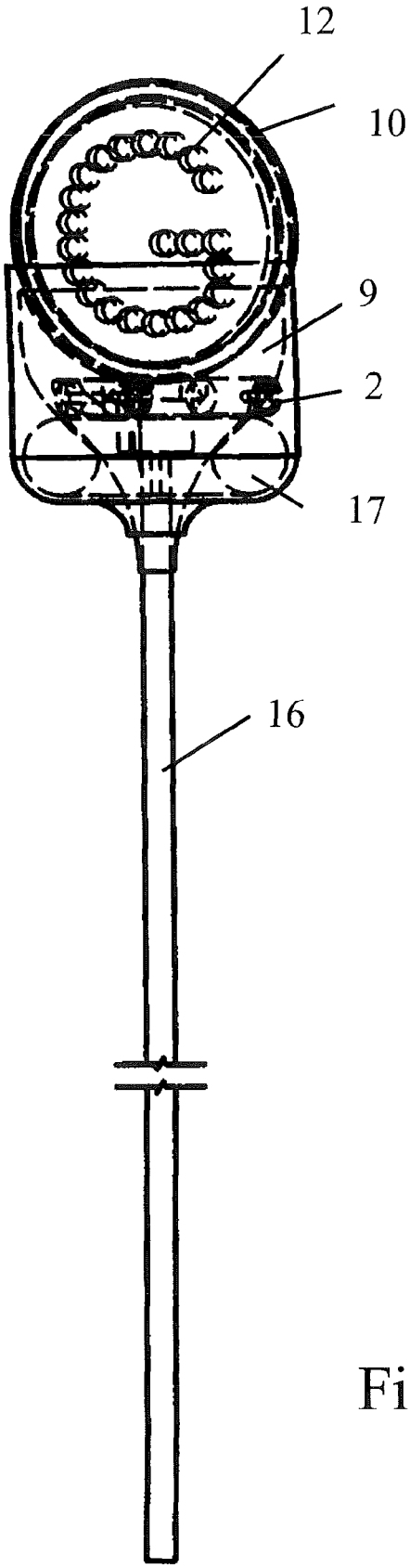
Figures 1, 7:
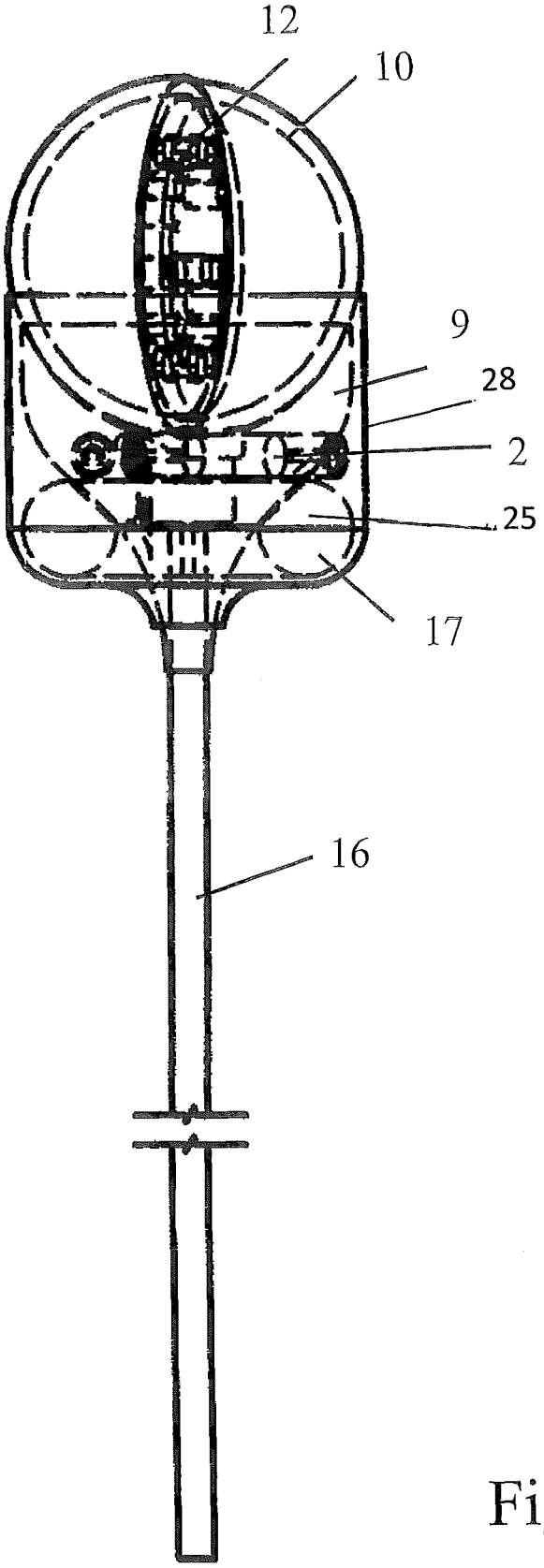

FIG. 7 shows the firework accommodating apparatus according to the invention 9 as a longitudinal section from the side, where the firework accommodating apparatus according to the invention 9 with firework 10 with effect composition in the form of the letter G 12 can be seen which is horizontal with respect to the observer. Furthermore a section through the hose 17 of the lift charge filled with black powder can be seen and the lateral cylindrical hollow bores 2 in the shaped body and the guide rod 16 can be seen.

FIG. 7-1

FIG. 7-1 shows the firework accommodating apparatus according to the invention 9 as a longitudinal section from the side, where the firework accommodating apparatus according to the invention 9 with firework 10 with effect composition in the form of the letter G 12 can be seen which is now facing away from the observer. Furthermore a section through the hose 17 of the lift charge filled with black powder can be seen and the lateral cylindrical hollow bores 2 in the shaped body and the guide rod 16 can be seen. Further, the firework can be cylindrical or projectile-shaped and has grooves 28 turned in the outer side.

FIG. 8

Figure 8:
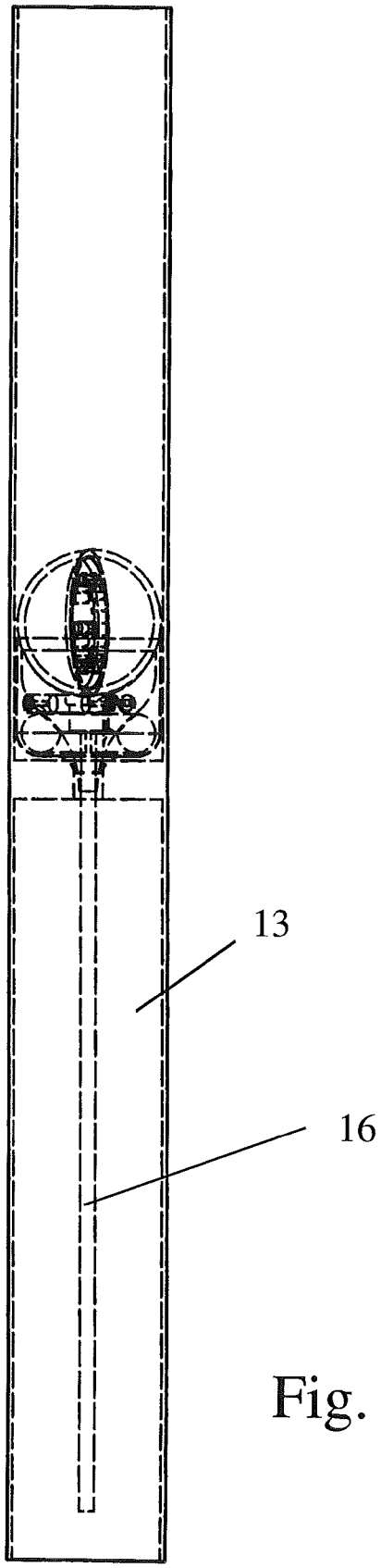
FIG. 8 shows a side view of the firework accommodating apparatus according to the invention from FIGS. 7, 7-1 in a mortar ready for launch.

FIG. 8 shows the firework accommodating apparatus according to the invention from FIGS. 7, 7-1 from the side in a mortar 13 ready for launch, where the firework accommodating apparatus according to the invention with firework, with the sign for display in the sky, the firework and the guide rod 16 can be seen.

FIG. 9

Figure 9:
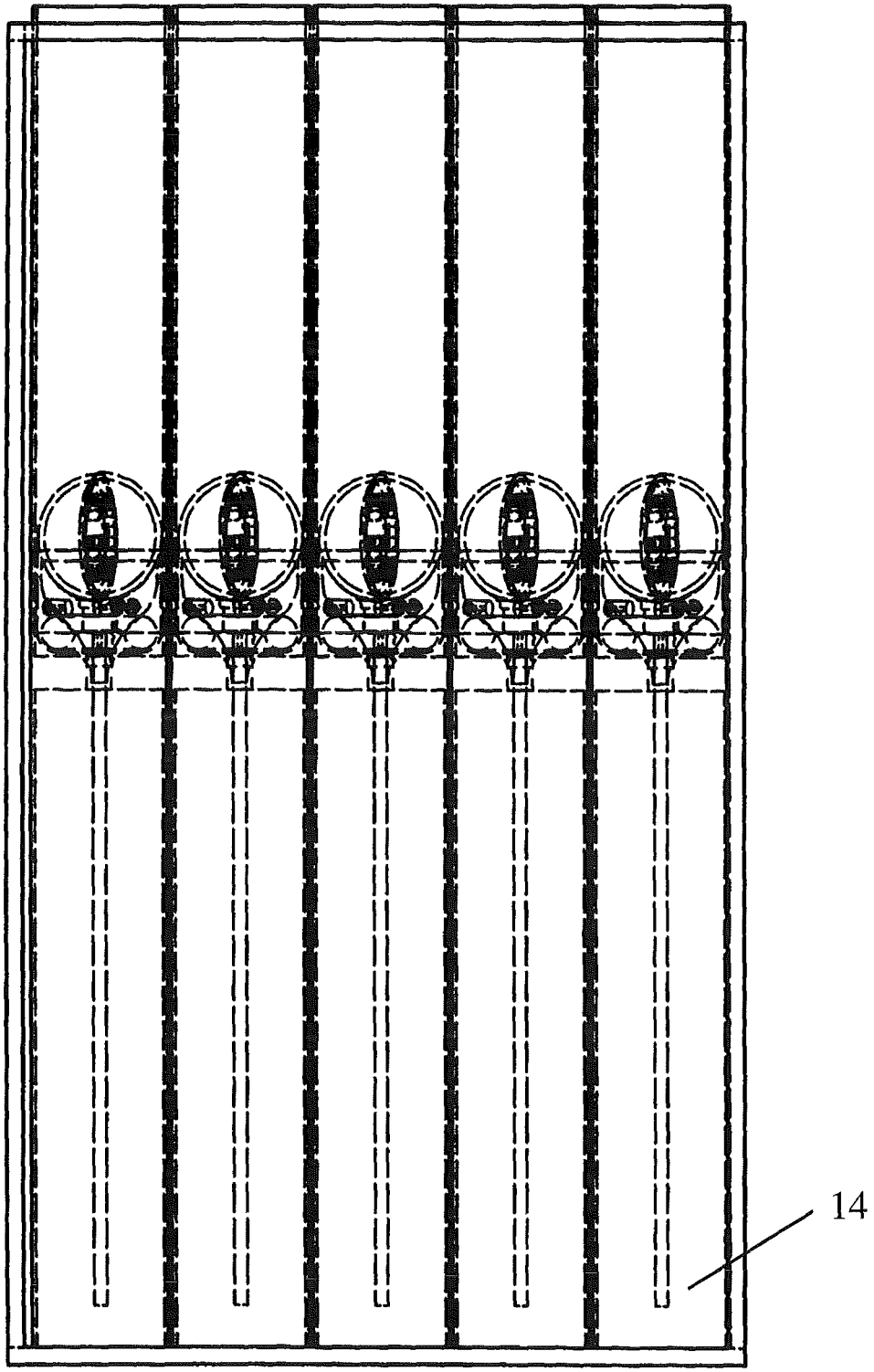
FIG. 9 shows a side view of the firework accommodating apparatuses according to the invention from FIGS. 7, 7-1 in a mortar rack.

FIG. 9 shows the firework accommodating apparatuses according to the invention from FIGS. 7, 7-1 from the side in a mortar rack 14, i.e. a mortar battery ready for launch, where the firework accommodating apparatus according to the invention with the sign for display in the sky, the firework and the guide rod 16 can be seen.

FIG. 10

Figure 10:
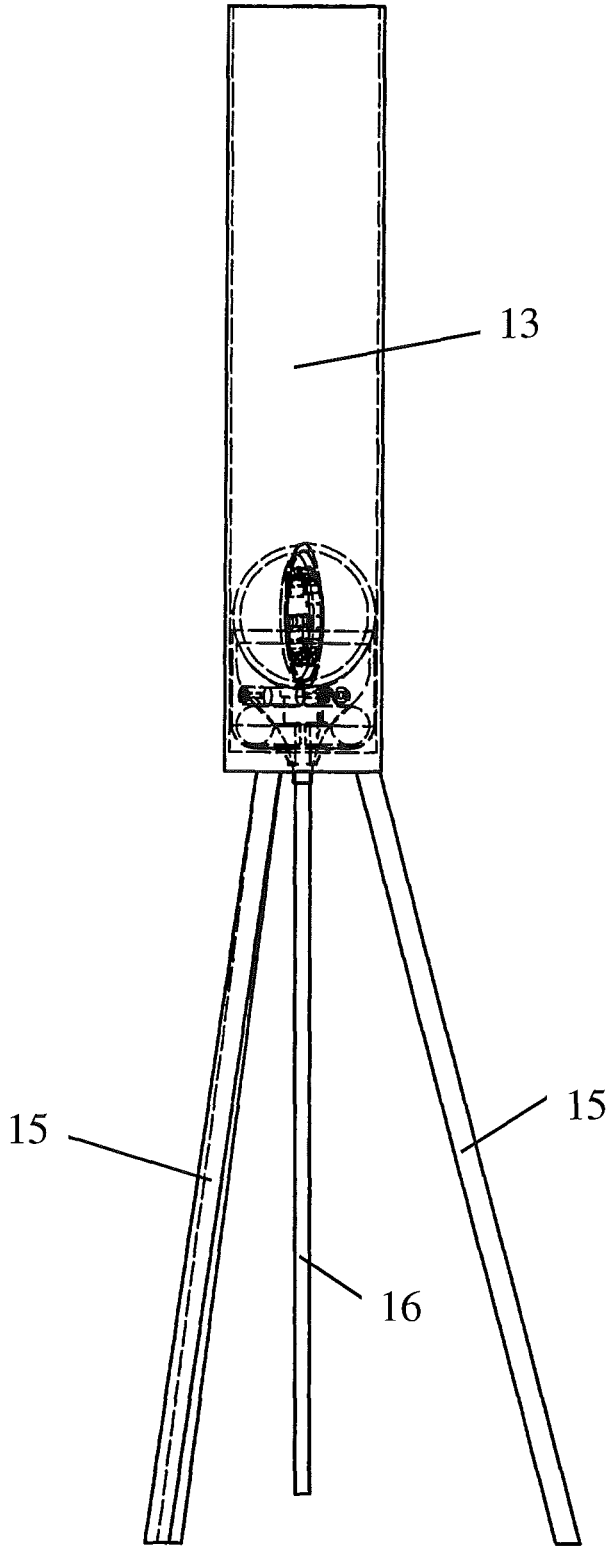
FIG. 10 shows a side view of the firework accommodating apparatus according to the invention from FIGS. 7, 7-1 with guide rod in a holder for an individual mortar in the form of a tripod.

FIG. 10 shows the firework accommodating apparatus according to the invention from FIGS. 7, 7-1 with guide rod 16, from the side in a holder for an individual mortar 13 in the form of a tripod 15 with standing platforms at the end of the legs (not visible) which distribute the enormous forces produced during launching over a larger area.

What we claim is:

1. A firework accommodating apparatus comprising:

a shaped body with an upwardly open recess and a first open bore centrally located at a bottom in the shaped body, the shaped body further comprising a second bore having a smaller diameter than the first bore, wherein the second bore is located adjacent to the first bore;

a firework that is connected to the firework accommodating apparatus, said firework comprising at its bottom a guide rod, a lift charge and a burst charge; wherein the first bore is adapted to receive the guide rod; and the shaped body has at least two lateral cylindrical hollow bores or two downwardly inclined wings and the shaped body has an electronic unit with at least one sensor for measuring the Earth's magnetic field.

2. The firework accommodating apparatus according to claim 1, wherein the first open bore at the bottom of the shaped body has a cylindrical hollow extension.

3. The firework accommodating apparatus according to claim 1, wherein the shaped body forms a hollow hemisphere.

4. The firework accommodating apparatus according to claim 1, wherein the position of the shaped body is determined in three-dimensional space by processing radio signals from communication or navigation satellites.

5. The firework accommodating apparatus according to claim 1, wherein the shaped body has a sensor for determining acceleration.

6. The firework accommodating apparatus according to claim 1, wherein the sensor for determining the Earth's magnetic field is mounted obliquely to a longitudinal axis.

7. The firework accommodating apparatus according to claim 1, wherein the at least one sensor has a first magnetic field sensor whose active surface is aligned perpendicularly to a longitudinal axis and a second magnetic field sensor whose active surface is aligned horizontally to the longitudinal axis.

8. The firework accommodating apparatus according to claim 1, wherein the shaped body has an apparatus that is adapted to set a time of firing of a burst charge.

9. The firework according to claim 1, wherein the firework is cylindrical or at least partially conical and has grooves turned in an outer side of the firework.

10. A method for launching a firework having a firework accommodating apparatus according to claim 1, the method comprising the step of inserting the firework in a mortar for launching which is positioned and fixed in an elevated position so that the guide rod of the firework can project downwards without touching ground.

11. The method for launching a firework according to claim 10 wherein the mortar has a base with an opening for the guide rod in a center of the mortar and that a mortar tube extends downwards, wherein the mortar tube is open at the bottom or can be closed by the base wherein when the mortar tube is fitted with the base, the mortar tube can have a closable opening in the base so that a lower tube piece can be cleaned.

12. The method for launching a firework according to claim 10 wherein the mortar has helical grooves or the mortar has a polygonal structure in order to set the firework in rotation.

13. A firework accommodating apparatus comprising:

a shaped body with an upwardly open recess and a first open bore centrally located at a bottom in the shaped body, the shaped body further comprising a second bore having a smaller diameter than the first bore, wherein the second bore is located adjacent to the first bore; and a firework that is connected to the firework accommodating apparatus; wherein the first bore is adapted to receive a guide rod; and the shaped body has at least two lateral cylindrical hollow bores or two downwardly inclined wings and the shaped body has an electronic unit with at least one sensor for measuring the Earth's magnetic field; and a sign is formed by metal salts which produce colour effects.

14. A firework accommodating apparatus comprising:

a shaped body with an upwardly open recess and a first open bore centrally located at a bottom in the shaped body, the shaped body further comprising a second bore having a smaller diameter than the first bore, wherein the second bore is located adjacent to the first bore;

a firework that is connected to the firework accommodating apparatus; wherein the first bore is adapted to receive a guide rod; and the shaped body has at least two lateral cylindrical hollow bores or two downwardly inclined wings and the shaped body has an electronic unit with at least one sensor for measuring the Earth's magnetic field; and an energy supply for the electronic unit is provided by capacitors.

15. The firework according to claim 14, wherein the electronic unit is programmed with parameters before launching wherein these data are stored in a non-volatile manner in the electronic unit, in a flash memory or an electrically erasable programmable read-only memory (EEPROM).

* * * * *